US010186144B2

(12) United States Patent
Hinton et al.

(10) Patent No.: US 10,186,144 B2
(45) **Date of Patent: *Jan. 22, 2019**

(54) SELF-LEVELING SYSTEM FOR A MOBILE HYDRAULIC CONCERT STAGE

(71) Applicant: Progressive Products, Inc., Pittsburg, KS (US)

(72) Inventors: Stephen T. Hinton, Pittsburg, KS (US); Todd N. Allison, Pittsburg, KS (US)

(73) Assignee: Progressive Products, Inc., Pittsburg, KS (US)

( * ) Notice: Subject to any disclaimer, the term of this patent is extended or adjusted under 35 U.S.C. 154(b) by 240 days.

This patent is subject to a terminal disclaimer.

(21) Appl. No.: 15/191,244

(22) Filed: Jun. 23, 2016

(65) Prior Publication Data

US 2016/0341222 A1 Nov. 24, 2016

Related U.S. Application Data

(63) Continuation-in-part of application No. 15/162,265, filed on May 23, 2016.

(60) Provisional application No. 62/184,152, filed on Jun. 24, 2015, provisional application No. 62/165,492, filed on May 22, 2015.

(51) Int. Cl.

| | |
|---|---|
| ***G08C 17/02*** | (2006.01) |
| ***E04H 3/28*** | (2006.01) |
| ***E04H 3/26*** | (2006.01) |
| ***E04H 15/62*** | (2006.01) |

(52) U.S. Cl.

CPC ..... *G08C 17/02* (2013.01); *E04H 3/26* (2013.01); *E04H 3/28* (2013.01); *E04H 15/62* (2013.01)

(58) Field of Classification Search

CPC ..... E04H 3/28; H04W 4/80

See application file for complete search history.

(56) References Cited

U.S. PATENT DOCUMENTS

| | | | | |
|---|---|---|---|---|
| 2,052,757 | A | 9/1936 | Fitch | |
| 2,143,235 | A | 1/1939 | Bassett | |
| 2,857,993 | A | 10/1958 | Terrell | |
| 3,002,557 | A | 10/1961 | Roth et al. | |
| 3,044,540 | A | 7/1962 | Hammersley | |
| 3,181,203 | A | 5/1965 | Wenger | |
| 3,258,884 | A | 7/1966 | Wenger | |
| 3,417,518 | A | 12/1968 | Christopher | |
| 3,433,500 | A | 3/1969 | Christensen | |
| 3,527,470 | A | 9/1970 | Ord | |
| 3,547,459 | A | 12/1970 | Lapham | |
| 3,620,564 | A * | 11/1971 | Wenger | B60P 3/0252 160/19 |
| 3,633,324 | A | 1/1972 | Cuylits | |

(Continued)

*Primary Examiner* — Thomas E Lazo

(74) *Attorney, Agent, or Firm* — Law Office of Mark Brown, LLC; Christopher M. DeBacker

(57) ABSTRACT

A deployable mobile stage system with an automatic leveling system. A remote controlling device interfaces with an internal controller of the mobile stage for transforming the stage from a transport position to a deployed position. Multiple level sensors provide feedback to the controller of the stage to automatically level the stage using jacks and outriggers hydraulically or mechanically controlled by the controller. The level sensors could be 3-axis sensors which provide level data to the CPU of the internal controller, which then forms determinations as to which jacks to raise or lower, when, and at what rate.

4 Claims, 3 Drawing Sheets

(56) References Cited

U.S. PATENT DOCUMENTS

| | | | | | |
|---|---|---|---|---|---|
| 3,908,787 | A | | 9/1975 | Wenger et al. | |
| 3,984,949 | A | | 10/1976 | Wahlquist | |
| 3,985,254 | A | | 10/1976 | Grandury | |
| 4,026,076 | A | | 5/1977 | Analetto | |
| 4,232,488 | A | | 12/1980 | Hanley | |
| 4,464,868 | A | | 8/1984 | Howroyd | |
| 4,535,933 | A | | 8/1985 | Kuiper | |
| 4,720,945 | A | | 1/1988 | Berranger et al. | |
| 4,869,030 | A | | 9/1989 | Clark | |
| 4,883,306 | A | | 11/1989 | Stucky | |
| 4,917,217 | A | | 4/1990 | Rogers et al. | |
| 4,934,113 | A | | 6/1990 | Hall | |
| 4,949,649 | A | | 8/1990 | Terres et al. | |
| 5,078,442 | A | | 1/1992 | Rau et al. | |
| 5,094,285 | A | | 3/1992 | Murray | |
| 5,115,608 | A | | 5/1992 | Abraham et al. | |
| 5,152,109 | A | * | 10/1992 | Boers | B60P 3/0252 296/26.02 |
| RE34,468 | E | | 12/1993 | Rau et al. | |
| 5,327,698 | A | | 7/1994 | Uhl | |
| 5,375,899 | A | | 12/1994 | Wright | |
| 5,398,463 | A | | 3/1995 | Wright | |
| 5,400,551 | A | | 3/1995 | Uhl | |
| 5,417,468 | A | | 5/1995 | Baumgartner et al. | |
| 5,454,441 | A | | 10/1995 | Jines | |
| 5,524,691 | A | | 6/1996 | Jines | |
| 5,546,709 | A | * | 8/1996 | Decker | E04H 3/28 296/26.07 |
| 5,622,011 | A | | 4/1997 | Jines | |
| 5,651,405 | A | | 7/1997 | Boeddeker et al. | |
| 5,706,616 | A | | 1/1998 | Fernandez | |
| 5,716,090 | A | | 2/1998 | Chang et al. | |
| 5,761,854 | A | | 6/1998 | Johnson et al. | |
| 5,875,591 | A | | 3/1999 | Jines | |
| 5,924,465 | A | | 7/1999 | Malott | |
| 5,947,502 | A | | 9/1999 | Kammerzell et al. | |
| 6,058,671 | A | | 5/2000 | Strickland | |
| 6,085,861 | A | | 7/2000 | Jines | |
| 6,176,495 | B1 | * | 1/2001 | Decker | B60S 9/12 280/6.153 |
| 6,393,769 | B1 | | 5/2002 | Mertik et al. | |
| 6,407,798 | B2 | | 6/2002 | Graves et al. | |
| 6,434,895 | B1 | | 8/2002 | Hosterman et al. | |
| 6,499,258 | B1 | | 12/2002 | Borglum | |
| 6,997,495 | B1 | | 2/2006 | Groezinger | |
| 7,213,869 | B1 | | 5/2007 | McClellan | |
| 7,500,285 | B2 | | 3/2009 | Willis | |
| 7,506,405 | B2 | | 3/2009 | Willis | |
| 8,678,941 | B2 | * | 3/2014 | Bilsen | B60P 3/0252 446/427 |
| 8,978,311 | B1 | * | 3/2015 | Uhl | B60P 3/0252 52/36.1 |
| 2002/0062605 | A1 | | 5/2002 | Matthews | |
| 2004/0108750 | A1 | | 6/2004 | Park | |
| 2008/0236055 | A1 | | 10/2008 | Laprise | |
| 2009/0126281 | A1 | | 5/2009 | Santini | |
| 2010/0024314 | A1 | | 2/2010 | Pope | |
| 2011/0031237 | A1 | | 2/2011 | Bilchinsky et al. | |
| 2012/0096775 | A1 | | 4/2012 | Allison | |
| 2012/0272585 | A1 | | 11/2012 | Bilsen et al. | |
| 2013/0067829 | A1 | | 3/2013 | Johnstone | |
| 2014/0069025 | A1 | | 3/2014 | Maxam | |
| 2015/0162865 | A1 | * | 6/2015 | Cowham | H02S 10/40 136/251 |

* cited by examiner

SELF-LEVELING SYSTEM FOR A MOBILE HYDRAULIC CONCERT STAGE

CROSS-REFERENCE TO RELATED APPLICATIONS

This application claims the benefit of U.S. Provisional Patent Application No. 62/184,152, filed Jun. 24, 2015, and is a continuation in part of and claims priority in U.S. patent application Ser. No. 15/162,265, filed May 23, 2016, which claims the benefit of U.S. Provisional Patent Application No. 62/165,492, filed May 22, 2015, all of which are incorporated herein by reference.

BACKGROUND OF THE INVENTION

1. Field of the Invention

The present invention relates generally to a wireless control system and method for use thereof, and more specifically to a wireless control system for a mobile hydraulic transforming stage system including self-leveling features.

2. Description of the Related Art

When mobile hydraulic stages are set up on site, one of the first steps involves leveling the stage. This is done, naturally, to ensure stability of the stage during use.

Mobile hydraulic stages commonly have a number of hydraulically and/or mechanically operated jacks which are manually actuated to ensure the stage is level. These jacks are actuated and then manually checked with a common level at various points around the stage.

The issues with manual actuation/level-checking of the jacks is that it is time consuming (and not as accurate).

Mobile performance stages are commonly used for temporary venues, performances, or rallies. Typical mobile performance stages must be assembled on site. Modern mobile stages may come in the form of a trailer, wherein the mobile stage is collapsible to a compact and mobile unit.

Mobile stages are often an economical alternative to erecting a permanent stage at a site. The typical reasons for electing to use a mobile stage include temporary use, cost, and reliability. Cutting the costs of using a mobile stage provides additional incentive for using a mobile stage. The simplest way to cut costs would be to reduce the number of persons and steps required to setup and operate the stage. Costs are also saved when the owner of a mobile stage knows the stage will last. These cost savings can be passed on to customers, increasing the incentive to use one mobile stage over another.

What is needed is a highly transportable stage system with a controller to allow the stage to be transformed from a compact/transportation position to a functional stage position and back.

BRIEF SUMMARY OF THE INVENTION

The present invention generally provides a self-leveling system for a deployable mobile hydraulic concert stage. A remote mobile computing device may be used for controlling the hydraulic system of the stage, where self-leveling sensors ensure the stage is level between or during commands sent by the remote mobile computing device. The mobile computing device can be any basic personal computing device such as a smart phone, tablet computer, laptop, smart watch (or other smart accessory) or a proprietary control unit. The mobile computing device interfaces wirelessly with a receiver unit located on the mobile stage. The receiver unit relays commands to a hydraulic system which then commands various valves to open and/or close, thereby transforming the mobile stage from a first, deployed position to a second, transport position or back. The leveling sensors maintain stage stability while the stage is in the first, deployed position.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning. Additional examples include computing devices such as a mobile smart device including a display device for viewing a typical web browser or user interface will be commonly referred to throughout the following description. The type of device, computer, display, or user interface may vary when practicing an embodiment of the present invention. A computing device could be represented by a desktop personal computer, a laptop computer, "smart" mobile phones, PDAs, tablets, smart watches, or other handheld computing devices.

II. Preferred Embodiment Self-Leveling Mobile Stage System 2

Previously, the operation of a mobile hydraulic stage has required a user to manipulate the stage set-up using either a wired or wireless control pack. This can be cumbersome to the user as these packs are often large and inconvenient to carry around. However, modern mobile devices such as cell phones, tablets, laptops and wearable technology have wireless technology built into them and are commonplace in today's society. Being able to use an application installed onto one of these small, mobile "smart" devices to operate a mobile hydraulic stage provides a user with a much more convenient process when setting up or taking down the stage. These operations involve walking, climbing and otherwise moving around the stage performing inspections to ensure that the stage is properly deployed and that it properly returns to a pre-set-up state. Using a small "smart" wireless device to control the stage during these procedures would expedite the process and allow the operator freedom of motion without being restrained by physical wires or cumbersome control units.

Figure 1:
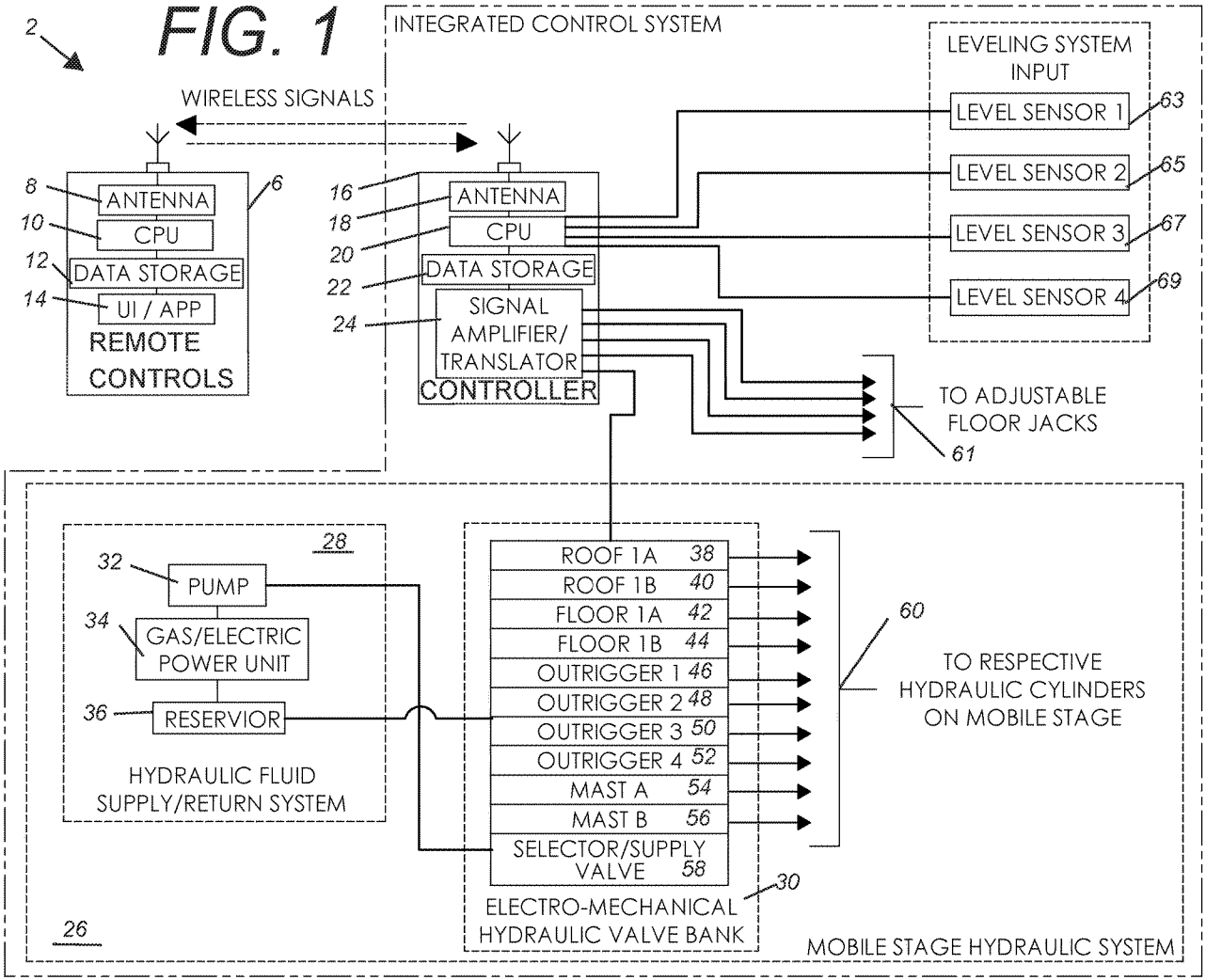
FIG. 1 is a box diagram representing the elements encompassing a preferred embodiment of the present invention.

Bluetooth and Wi-Fi are two commonly present forms of wireless technology which could be used to interface from the control application to the stage, however, any wireless technology available (now or in the future) could be used instead Referring to the figures in more detail, FIG. 1 outlines the components of a self-leveling system 2 used on a mobile hydraulic stage 4 which may automatically actuate all leveling jacks 61 on the stage using a plurality of sensors (e.g. leveling sensors 63, 65, 67, 69) placed in various locations of the stage itself for providing feedback data to a controller 16 CPU 20. The sensors 63, 65, 67, 69 could be calibrated to offer a certain level of accuracy. Actuation itself could be done via electronic hydraulic valves 38-56 and/or a mechanical system of some sort. It may also be possible to level only portions of the stage, although common that the entire foundation be leveled at once.

The user may control the self-leveling system via a remote control unit 6, such as a mobile computing device, which may include a control screen, switches, and/or levers integrated into the stage or as part of a wireless control system separate from the stage. The user may also have the ability to interrupt and control the speed of this process once underway, if needed. In the case of a remote computer, it would necessarily include an antenna 8 for wirelessly communicating with the local controller 16 of the stage 4, along with data storage 12 for storing a software user interface application 14 which allows the user to interact with the stage remotely and a CPU 10. Similarly, the local controller 16 would require an antenna 18 for sending and receiving wireless signals with the remote controls 6, along with the local CPU 20, data storage 22, and a signal amplifier/translator 24. Signals out from the local controller 16 would then automatically feed to the adjustable floor jacks 61 based upon signals received by the level sensors 63, 65, 67, 69. It should be noted that any number of level sensors could be used, the more used providing increased feedback potential and accuracy. A preferred embodiment will utilize 3-axis level sensors which the CPU 20 will control for acceptable limits of tilt along each axis. Automation of the leveling of the stage is the ultimate goal of this invention.

Taking this a step further, the leveling system 2 itself may be able to offer feedback on if certain parts of the system are faulty, assuming the system fails to successfully level the stage. This could include indicators that one or more of the floor jacks 61 are failing to provide adequate lift to the stage floor.

Figure 2:
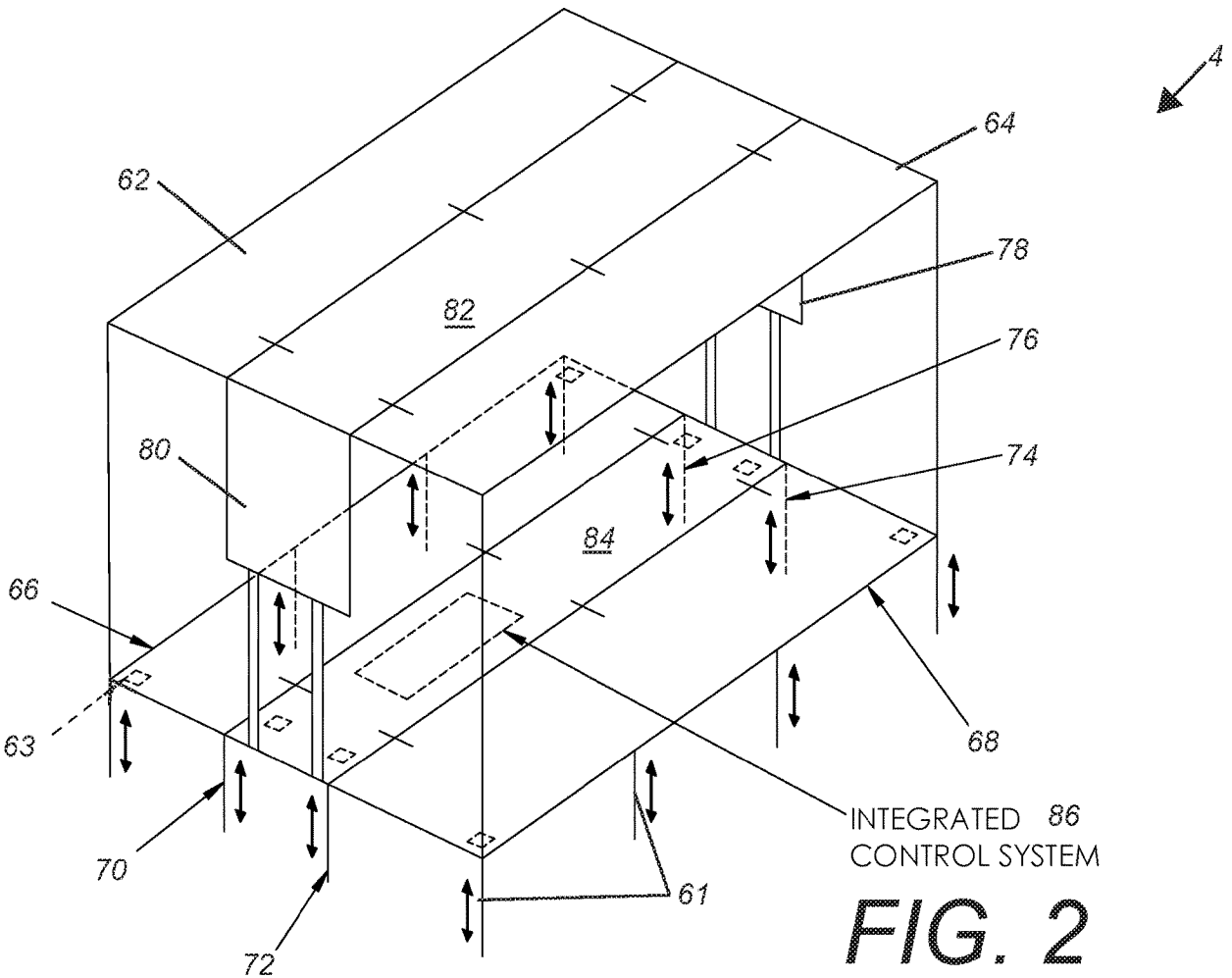
FIG. 2 is a three-dimensional isometric view of a mobile stage in a first, deployed position as controlled via a preferred embodiment of the present invention.

As shown through FIGS. 1 and 2, the mobile stage hydraulic system 26 is made of up generally two parts: the hydraulic fluid supply and return system 28 and the electro-mechanical hydraulic valve bank 30. The fluid supply/return system 28 generally includes the pump 32 for the hydraulic fluid, a power unit 34 (e.g. gasoline, diesel, or electric motor), and a fluid reservoir 36 for storing the hydraulic fluid.

The electro-mechanical hydraulic valve bank 30 includes a number of valves corresponding with respective components of the mobile stage 4 as shown in FIG. 2. A roof 1A valve 38 connects to and controls a roof 1A panel 62 which hinges away from the static roof panel 82, and a similar roof 1B valve 40 connects to and controls a roof 1B panel 64 which again hinges away from the central static roof panel 82, as depicted in FIG. 2. This forms a covering for the floor of the stage.

A floor 1A valve 42 is connected to and controls a floor 1A panel 66 which hinges away from a central static floor panel 84. Similarly a floor 1B valve 44 is connected to and controls a floor 1B panel 68 which hinges the opposite direction away from the static central floor panel 84. This forms the base of the stage.

Four outrigger valves, outrigger #1 46; outrigger #2 48; outrigger #3 50; and outrigger #4 52, correspond with and connect and control respective outrigger #1 70; outrigger #2 72; outrigger #3 74; and outrigger #4 76 to raise and lower the stage floor from the ground.

Two mast valves, mast A 54 and mast B 56 respectively connect to and control a pair of masts, mast A 78 and mast B 80, which raise and lower the sides of the stage, thereby raising the roof panels 62, 64, 82 away from the floor panels 66, 68, 84.

The various valves 38-56 receive hydraulic fluid through a selector/supply valve 58 and dispense hydraulic fluid out to the various respective components of the mobile stage 4 through an outlet 60 to the various hydraulic cylinders.

The integrated control system 86 of the stage itself includes all of the functional components of the mobile stage 4, including the hydraulic system 26, the controller 16, and the various leveling sensors 63, 65, 67, 69, along with all communication elements for receiving feedback from the various jacks 61 and other hydraulic components of the hydraulic system 26.

Figure 3:
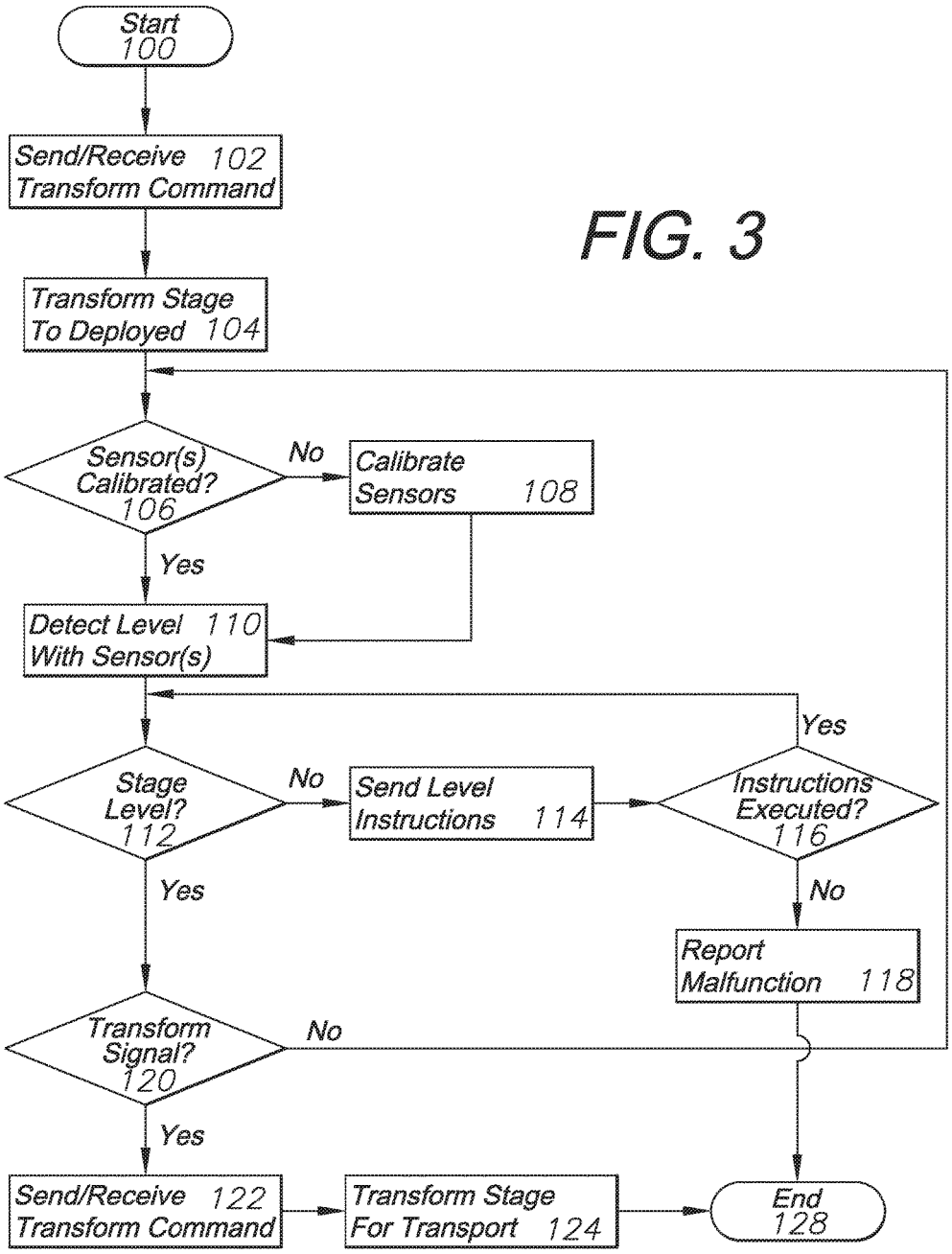
FIG. 3 is a flowchart diagramming the steps taken by a computer in connection with a mobile hydraulic stage when performing functions of the present invention.

FIG. 3 shows the steps taken by the auto-leveling system 2 when the mobile stage 4 is being deployed at a specified location. The process starts at 100 and the signal is sent from the remote control unit 6 to the controller 16 of the stage at step 102 to transform the stage from a transport position at step 104 to a deployed position as shown in FIG. 2.

The system will make a determination at step 106 whether the leveling sensors are calibrated correctly. If not, the sensors are calibrated at 108. Upon a determination or calibration of the leveling sensors, the sensors will monitor and detect whether the stage floor is level at step 110. A determination of whether the stage is level is made at step 112. If it is determined that the stage is not level, level instructions are sent out from the controller 16 to the various leveling jacks 61 at step 114. A check is provided at step 116 to determine if the instructions for leveling the stage have been received at the jacks. If not, this means there is a malfunction in one or more of the jacks or the stage system itself. At this point the malfunction is reported to the user at 118, which ends the process at 128 until the malfunction can be corrected.

The stage is leveled at 114 and checked for level at 112 until a determination that the stage is level is made at 112. After the stage is level, the system will monitor whether any instructions to transform the stage back into a transport position are received by the controller 16 at step 120. If no instruction is received, the cycle continues where the system constantly monitors for calibration of the sensors at 106, detection of the level of the stage at 110 and 112, and whether a transform signal is received at 120.

Once a transform signal is received at 120, the signal is passed on to the hydraulic stage system at 122, and the stage is transformed at 124, which ends the stage leveling monitor process at 128.

The benefits of this system are that it will be faster and more accurate than traditional manual methods. It also adds significant safety functions in maintaining a level stage for performance purposes.

It is to be understood that while certain embodiments and/or aspects of the invention have been shown and described, the invention is not limited thereto and encompasses various other embodiments and aspects.

Having thus described the invention, what is claimed as new and desired to be secured by Letters Patent is:

1. A mobile stage control system comprising:

a remote controller configured to interact with a software application stored on a data storage and accessible by a CPU;

a controller unit affixed to a mobile stage, said receiver unit including said CPU, said data storage, and a signal amplifier, said controller unit configured to receive control commands from said remote controller;

a hydraulic system configured to transform said mobile stage from a first, deployed position to a second, transport position via a plurality of hydraulic valves connected to a plurality of structural elements of said mobile stage, said hydraulic system including at least one selector/supply valve;

a plurality of level sensors affixed to said mobile stage, said level sensors configured to provide level data to said controller unit based upon the level values of the mobile stage;

an external data source wireless in communication with said receiver unit;

said external data source transmitting control variables to said CPU of said receiver unit;

whereby said CPU may automatically send control commands to said hydraulic system based upon said control variables;

wherein control commands are sent, by said CPU, to said receiver unit, and wherein said commands instruct said hydraulic system to automatically move at least one of said plurality of structural elements of said mobile stage; and wherein said controller unit automatically controls a plurality of adjustable floor jacks to move said mobile stage based upon said level data, thereby causing said mobile stage to become level.

2. The mobile stage control system of claim 1, further comprising:

said mobile stage comprising a roof including a first roof panel and a second roof panel;

said hydraulic system including a first roof hydraulic valve corresponding with said first roof panel and a second roof hydraulic valve corresponding with said second roof panel;

wherein said first roof hydraulic valve is configured to activate a first roof hydraulic cylinder which moves said first roof panel from a first, deployed position to a second, transport position; and wherein said second roof hydraulic valve is configured to activate a second roof hydraulic cylinder which moves said second roof panel from a first, deployed position to a second, transport position.

3. The mobile stage control system of claim 1, further comprising:

said mobile stage comprising a floor including a first floor panel and a second floor panel;

said hydraulic system including a first floor hydraulic valve corresponding with said first floor panel and a second floor hydraulic valve corresponding with said second floor panel;

wherein said first floor hydraulic valve is configured to activate a first floor hydraulic cylinder which moves said first floor panel from a first, deployed position to a second, transport position; and wherein said second floor hydraulic valve is configured to activate a second floor hydraulic cylinder which moves said second floor panel from a first, deployed position to a second, transport position.

4. A method of operating a mobile stage, the method comprising the steps:

wirelessly transmitting, from a remote mobile computing device, commands to a mobile stage receiver unit, said remote mobile computing device including a CPU, data storage, communications antenna, and graphical user interface (GUI) configured to interact with a software application stored on said data storage and accessible by said CPU;

receiving, with said mobile stage receiver unit, said commands, said mobile stage receiver unit affixed to a mobile stage and including a communications antenna, a CPU, data storage, and a signal amplifier, said receiver unit configured to receive control commands from said remote mobile computing device;

controlling, with said mobile stage receiver unit, a hydraulic system configured to transform said mobile stage from a first position to a second position via a plurality of hydraulic valves connected to a plurality of structural elements of said mobile stage, said hydraulic system including at least one selector/supply valve;

activating said hydraulic system such that at least one of said plurality of structural elements of said mobile stage are moved via at least one hydraulic cylinder powered by said hydraulic system;

detecting with a plurality of level sensors whether a floor section of said mobile stage is level;

wirelessly receiving, with said mobile stage receiver unit, control variables transmitted by an external data source;

transmitting control variables to said CPU of said receiver unit;

automatically sending control commands, with said CPU of said receiver unit, to said hydraulic system based upon said control variables;

transmitting leveling data to said mobile stage receiver unit with said level sensors; and instructing said hydraulic system to automatically move one of said plurality of structural elements of said mobile stage, including to adjust at least one of a plurality of leveling jacks based upon said leveling data, thereby leveling said stage floor section.

* * * * *